US009846404B2

(12) United States Patent
Shikata et al.

(10) Patent No.: US 9,846,404 B2
(45) Date of Patent: Dec. 19, 2017

(54) OPENING-CLOSING PORTION AND IMAGE FORMING APPARATUS COMPRISING THE SAME

(71) Applicant: FUJI XEROX CO., Ltd., Tokyo (JP)

(72) Inventors: Masahito Shikata, Kanagawa (JP); Satoshi Tejima, Kanagawa (JP); Toru Inoda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/226,399

(22) Filed: Aug. 2, 2016

(65) Prior Publication Data

US 2017/0255158 A1 Sep. 7, 2017

(30) Foreign Application Priority Data

Mar. 1, 2016 (JP) ..... 2016-038945

(51) Int. Cl.
*G03G 21/16* (2006.01)

(52) U.S. Cl.
CPC . *G03G 21/1628* (2013.01); *G03G 2221/1687* (2013.01)

(58) Field of Classification Search
CPC ..... G03G 21/1628; G03G 2221/1687
See application file for complete search history.

(56) References Cited

U.S. PATENT DOCUMENTS 5,406,355 A * 4/1995 Komuro ..... G03G 21/1821 399/111
5,438,391 A * 8/1995 Maekawa ..... G03G 21/185 399/125
5,606,406 A * 2/1997 Ikeyama ..... G03G 21/1814 399/111
2004/0208676 A1* 10/2004 Ishii ..... G03G 21/1609 399/258
2005/0281581 A1* 12/2005 Kitozaki ..... G03G 21/1832 399/111
2006/0099008 A1* 5/2006 Kurita ..... G03G 15/0131 399/110
2006/0104661 A1* 5/2006 Nakanishi ..... G03G 15/1605 399/110

(Continued)

FOREIGN PATENT DOCUMENTS

JP 06-143743 A 5/1994
JP 2012-189954 A 10/2012

*Primary Examiner* — Rodney Bonnette
(74) *Attorney, Agent, or Firm* — Sughrue Mion, PLLC

(57) ABSTRACT

An image forming apparatus includes an object disposed in an apparatus body so as to be capable of being taken out through an opening; an opening-closing portion that is rotatable and that covers the opening and rotates upward to open the opening; and an operating portion that is rotatable and disposed in front of the opening-closing portion. The operating portion is disposed at a position on a rotation trajectory along which the opening-closing portion rotates upward and on a path along which the object is taken out of the apparatus body. The operating portion rotates forward so as to be retracted from the rotation trajectory and the path along which the object is taken out and so that the path along which the object is taken out is formed between the operating portion and the opening-closing portion in the open state.

20 Claims, 12 Drawing Sheets

(56) References Cited

U.S. PATENT DOCUMENTS

| | | | | |
|---|---|---|---|---|
| 2006/0104664 | A1* | 5/2006 | Nakahata | G03G 21/1853 399/111 |
| 2010/0232853 | A1* | 9/2010 | Sasaki | G03G 15/1605 399/381 |
| 2011/0229192 | A1* | 9/2011 | Okamoto | G03G 21/1623 399/110 |
| 2012/0237254 | A1* | 9/2012 | Fukuda | G03G 15/0194 399/114 |
| 2012/0243906 | A1* | 9/2012 | Watanabe | G03G 21/1832 399/114 |

* cited by examiner

OPENING-CLOSING PORTION AND IMAGE FORMING APPARATUS COMPRISING THE SAME

CROSS-REFERENCE TO RELATED APPLICATIONS

This application is based on and claims priority under 35 USC 119 from Japanese Patent Application No. 2016-038945 filed Mar. 1, 2016.

BACKGROUND

Technical Field

The present invention relates to an image forming apparatus.

SUMMARY

According to an aspect of the invention, there is provided an image forming apparatus including an object to be taken out, the object being disposed in an apparatus body so as to be capable of being taken out of the apparatus body through an opening in an upper section of the apparatus body; an opening-closing portion including a rear portion attached to the upper section of the apparatus body in such a manner that the opening-closing portion is rotatable around an axis that extends in a left-right direction of the apparatus, the opening-closing portion covering the opening from above and rotating upward to open the opening; and an operating portion attached to the upper section of the apparatus body so as to be rotatable around an axis that extends in the left-right direction of the apparatus at a location closer to a front of the apparatus than the opening-closing portion is. The operating portion is disposed at a position on a rotation trajectory along which the opening-closing portion rotates upward and on a path along which the object is taken out of the apparatus body through the opening. The operating portion rotates toward the front of the apparatus so as to be retracted from the rotation trajectory and the path along which the object is taken out, and so that the path along which the object is taken out is formed between the operating portion and the opening-closing portion in a state in which the opening-closing portion opens the opening.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings.

Image Forming Apparatus 10

Figure 1:
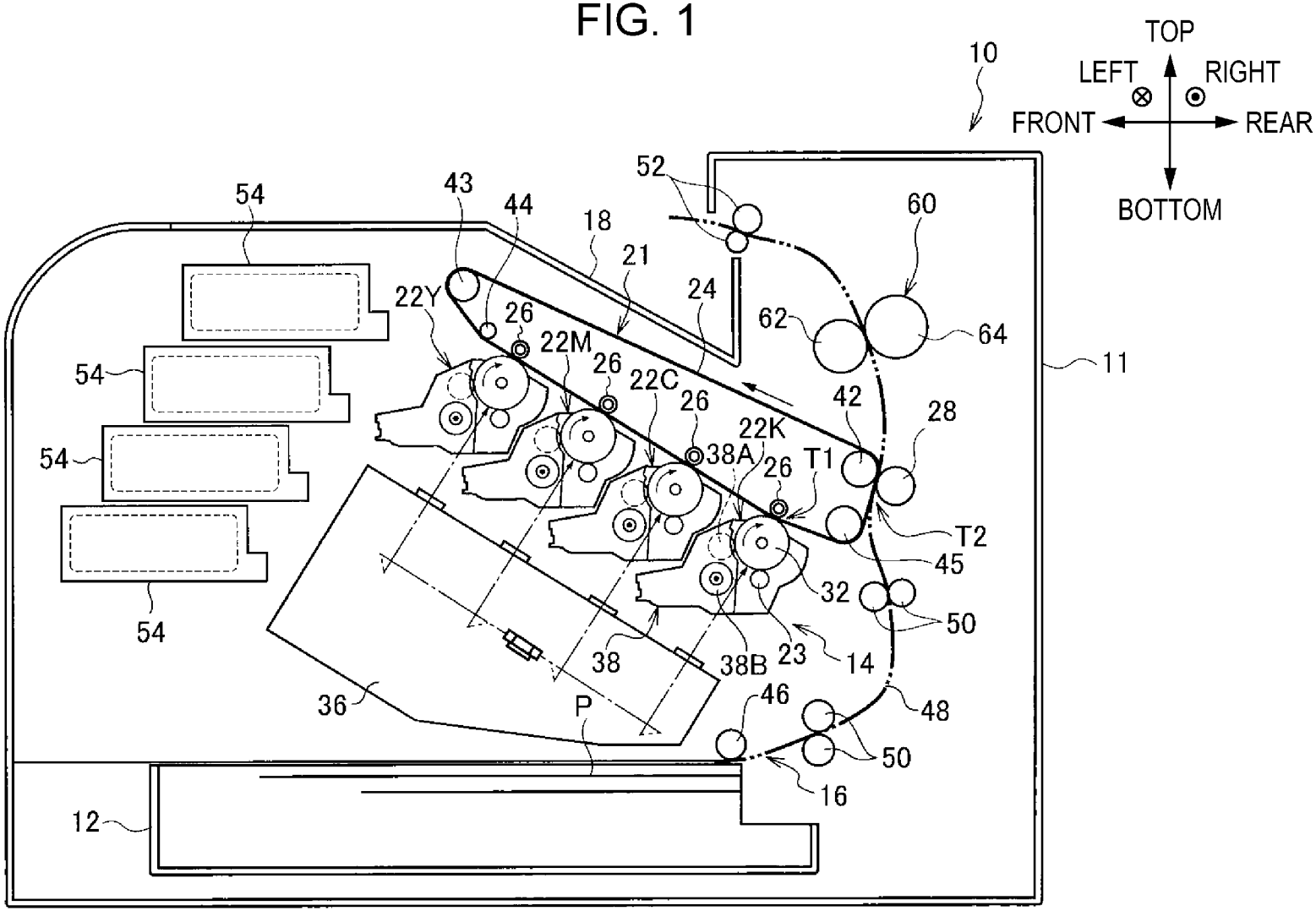
FIG. 1 is a schematic diagram illustrating the structure of an image forming apparatus according to an exemplary embodiment.

First, the structure of an image forming apparatus 10 will be described. FIG. 1 is a schematic diagram illustrating the structure of the image forming apparatus 10. In the following description, the front, rear, right, left, top, and bottom of the apparatus respectively correspond to the directions of arrows (FRONT, REAR, RIGHT, LEFT, TOP, and BOTTOM) in the drawings. The front, rear, right, left, top, and bottom of the apparatus may sometimes be referred to simply as front (front side), rear (rear side), right (right side), left (left side), top (top side), and bottom (bottom side). In the drawings, circles having "X" therein indicate the direction from the near side to the far side in each figure, and circles having dots therein indicate the direction from the far side to the near side in each figure.

As illustrated in FIG. 1, the image forming apparatus 10 includes an image forming apparatus body 11 (example of apparatus body) in which components are disposed. The components disposed in the image forming apparatus body 11 include a container 12, which contains recording media P, such as paper sheets; an image forming section 14, which forms an image on a recording medium P; a fixing device 60, which fixes the image formed on the recording medium P to the recording medium P; and a transport unit 16, which transports the recording medium P from the container 12 to the image forming section 14. An output portion 18, to which the recording medium P having the image fixed thereto by the fixing device 60 is output, is disposed in an upper section of the image forming apparatus body 11.

The image forming section 14 includes image forming units 22Y, 22M, 22C, and 22K (hereinafter referred to as image forming units 22Y to 22K), which serve as units for forming yellow (Y), magenta (M), cyan (C), and black (K) toner images, and a transfer unit 21 (example of an object to be taken out), which serves as a transfer device including an intermediate transfer belt 24 (transfer body). The toner images formed by the image forming units 22Y to 22K are transferred onto the intermediate transfer belt 24. The image forming section 14 also includes a second transfer roller 28 that transfers the toner images that have been transferred onto the intermediate transfer belt 24 by first transfer rollers 26 onto a recording medium P. The image forming section 14 does not necessarily have the above-described structure, and may have any structure as long as the image forming section 14 forms an image on the recording medium P.

The image forming units 22Y to 22K are arranged along a line inclined relative to the horizontal direction in the image forming apparatus body 11. Each of the image forming units 22Y to 22K includes a photoconductor 32 that rotates in one direction (for example, clockwise in FIG. 1). The image forming units 22Y to 22K have the same structure; therefore, reference numerals for components of the image forming units 22Y, 22M, and 22C are omitted in FIG. 1.

A charging roller 23 and a developing device 38 are arranged around each photoconductor 32 in that order from the upstream side in the rotation direction of the photoconductor 32. The charging roller 23 serves as a charging device that charges the photoconductor 32. The developing device 38 forms a toner image by developing an electrostatic latent image formed by an exposure process performed on the photoconductor 32 charged by the charging roller 23.

The developing device 38 includes a developer supplier 38A that supplies developer to the photoconductor 32 and a transport member 38B that transports the developer to be supplied to the developer supplier 38A while stirring the developer. Plural containers 54 that contain the developer to be supplied to the developing devices 38 of the image forming units 22Y to 22K are disposed in front of the image forming units 22Y to 22K.

An exposure device 36 is disposed below the image forming units 22Y to 22K. The exposure device 36 forms electrostatic latent images on the photoconductors 32 of the image forming units 22Y to 22K by performing an exposure process on the photoconductors 32 that have been charged by the charging rollers 23 of the image forming units 22Y to 22K.

The transfer unit 21 is disposed above the image forming units 22Y to 22K. The transfer unit 21 includes the intermediate transfer belt 24, wrap rollers 42, 43, 44, and 45 around which the intermediate transfer belt 24 is wrapped, and the first transfer rollers 26, which transfer the toner images formed by the image forming units 22Y to 22K onto the intermediate transfer belt 24.

The intermediate transfer belt 24 has an annular shape and is disposed above the image forming units 22Y to 22K. The wrap roller 43, for example, is rotated so that the intermediate transfer belt 24 moves, or rotates, in one direction (for example, counterclockwise in FIG. 1) while being in contact with the photoconductors 32. The wrap roller 42 serves as an opposing roller that opposes the second transfer roller 28.

Each first transfer roller 26 opposes the corresponding photoconductor 32 with the intermediate transfer belt 24 interposed therebetween. The space between each first transfer roller 26 and the corresponding photoconductor 32 is a first transfer position T1 at which the toner image formed on the photoconductor 32 is transferred onto the intermediate transfer belt 24.

A first transfer voltage having a polarity opposite to the toner polarity (first transfer current) is applied to each first transfer roller 26. Accordingly, a first transfer electric field is formed between the first transfer roller 26 and the corresponding photoconductor 32, so that the toner image formed on the photoconductor 32 receives an electrostatic force and is transferred onto the intermediate transfer belt 24 at the first transfer position T1.

The second transfer roller 28 opposes the wrap roller 42 with the intermediate transfer belt 24 interposed therebetween. The space between the second transfer roller 28 and the wrap roller 42 is a second transfer position T2 at which the toner images that have been transferred onto the intermediate transfer belt 24 are transferred onto the recording medium P.

A second transfer voltage having a polarity opposite to the toner polarity (second transfer current) is applied to the second transfer roller 28. Accordingly, a second transfer electric field is formed between the second transfer roller 28 and the wrap roller 42, so that the toner images on the intermediate transfer belt 24 receive an electrostatic force and are transferred onto the recording medium P at the second transfer position T2.

As illustrated in FIG. 1, the transport unit 16 includes a feed roller 46 that feeds a recording medium P contained in the container 12, a transport path 48 along which the recording medium P fed by the feed roller 46 is transported, and transport rollers 50 that transport the recording medium P fed by the feed roller 46 toward a downstream side. Among the transport rollers 50, the pair of rollers closest to the second transfer position T2 are registration rollers.

The fixing device 60 is located downstream of the second transfer position T2 in the transporting direction. The fixing device 60 includes a heating roller 62 and a pressing roller 64. The fixing device 60 fixes the toner images that have been transferred onto the recording medium P from the intermediate transfer belt 24 to the recording medium P by applying heat with the heating roller 62 and pressure with the pressing roller 64.

An image forming operation performed by the image forming apparatus 10 according to the present exemplary embodiment to form an image on a recording medium P will now be described.

In the image forming apparatus 10 according to the present exemplary embodiment, the recording medium P fed from the container 12 by the feed roller 46 is transported to the second transfer position T2 by the transport rollers 50 (see FIG. 1).

In each of the image forming units 22Y to 22K, the photoconductor 32 charged by the charging roller 23 is subjected to the exposure process by the exposure device 36, so that an electrostatic latent image is formed on the photoconductor 32. The electrostatic latent image is developed by the developing device 38, so that a toner image is formed on the photoconductor 32. The toner images of the respective colors formed by the image forming units 22Y to 22K are transferred onto the intermediate transfer belt 24 at the first transfer positions T1, so that a color image is formed. The color image formed on the intermediate transfer belt 24 is transferred onto the recording medium P at the second transfer position T2.

The recording medium P on which the toner image has been transferred is transported to the fixing device 60, and the fixing device 60 fixes the transferred toner image to the recording medium P. The recording medium P to which the toner image has been fixed is output to the output portion 18 by transport rollers 52. The image forming operation is performed in the above-described manner.

Structure of Transfer Unit 21

Figure 2:
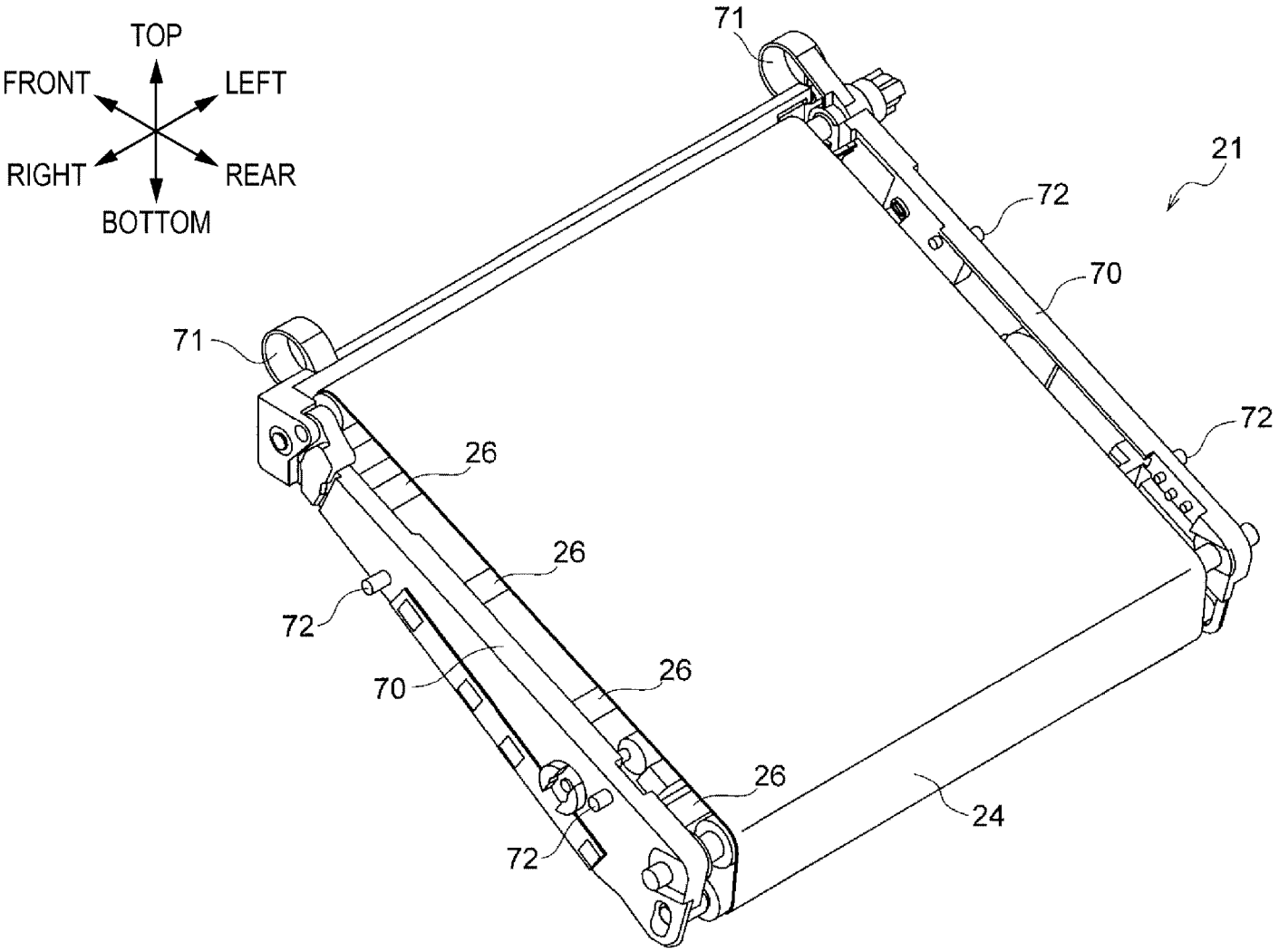
FIG. 2 is a perspective view illustrating the structure of a transfer unit according to the exemplary embodiment.

The structure of the transfer unit 21 will now be described. FIG. 2 illustrates the structure of the transfer unit 21. In FIGS. 4 to 8 and 10, the structure of the transfer unit 21 is simplified.

As illustrated in FIG. 2, the transfer unit 21 includes a pair of frame members 70 that form the frame of the transfer unit 21. The pair of frame members 70 are disposed one on each side (each of left and right sides) of the four first transfer rollers 26 in the rotational axis direction.

Each of the pair of frame members 70 has plural projections 72 on an outer surface thereof. The projections 72 function as guide portions that are guided by guide grooves (not shown) formed in inner walls of the image forming apparatus body 11 when the transfer unit 21 is attached to or detached from the image forming apparatus body 11.

Holder portions 71, which are held by an operator when the transfer unit 21 is attached to or detached from the image forming apparatus body 11, are provided at upper ends of front portions of the pair of frame members 70.

The transfer unit 21 is detached from the image forming apparatus body 11 after separating the intermediate transfer belt 24 from the photoconductors 32 by moving the four first transfer rollers 26, which are in contact with the inner peripheral surface of the intermediate transfer belt 24, upward with a retracting mechanism (not shown).

Structure for Detaching Transfer Unit 21 from Image Forming Apparatus Body 11

Figure 3:
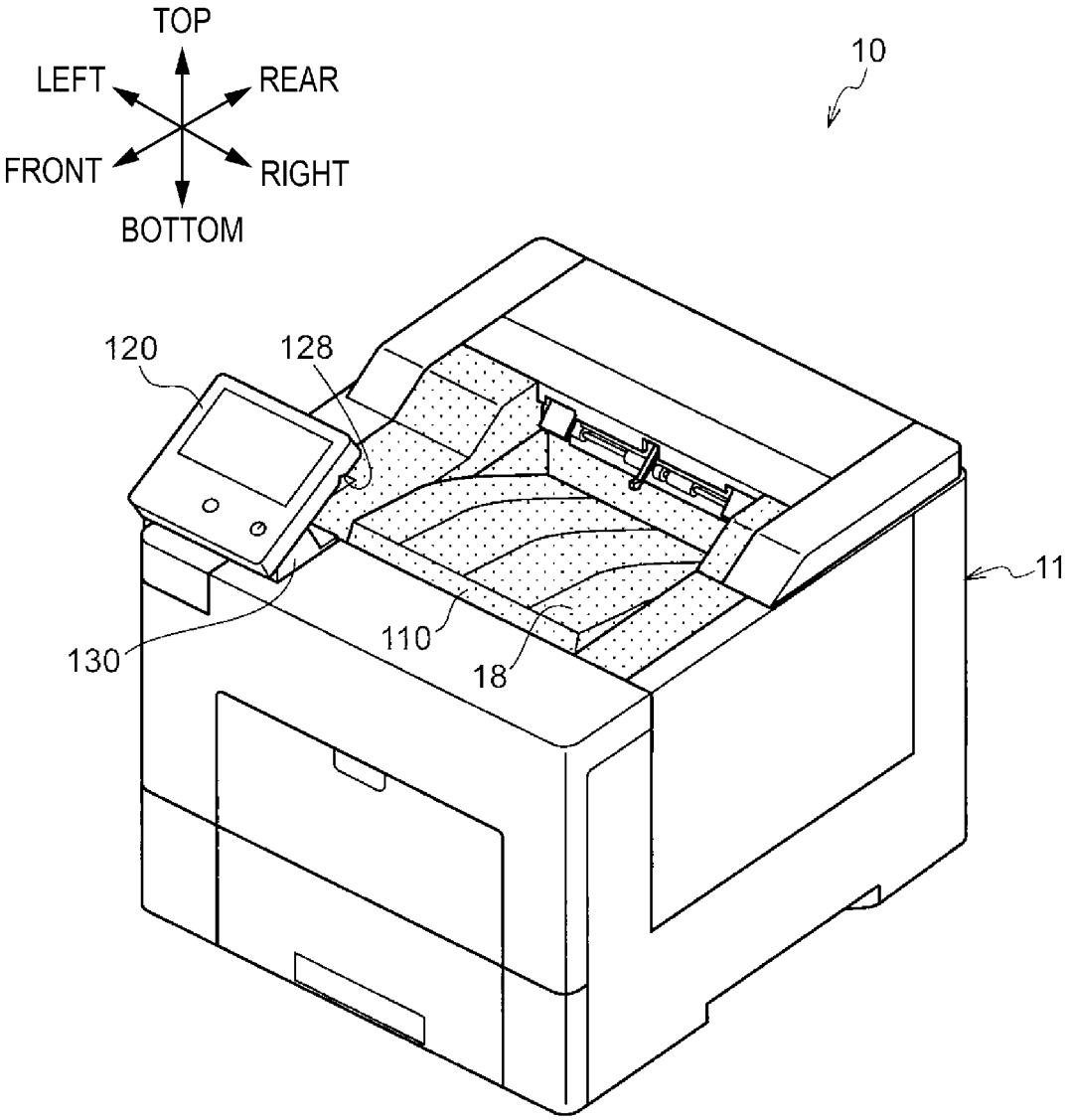
FIG. 3 is a perspective view illustrating the structure of the image forming apparatus according to the exemplary embodiment.
Figure 4:
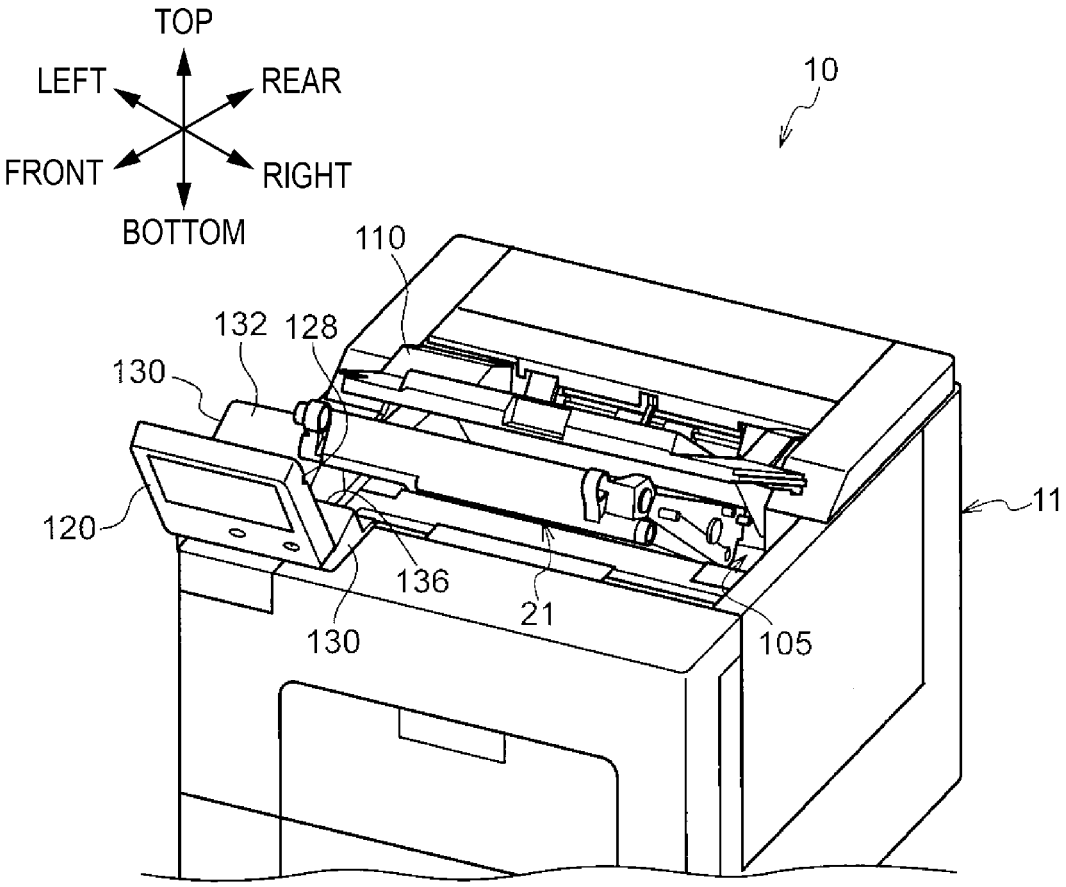
FIG. 4 is a perspective view illustrating the state in which the transfer unit is being taken out of an image forming apparatus body illustrated in FIG. 3.
Figure 5:
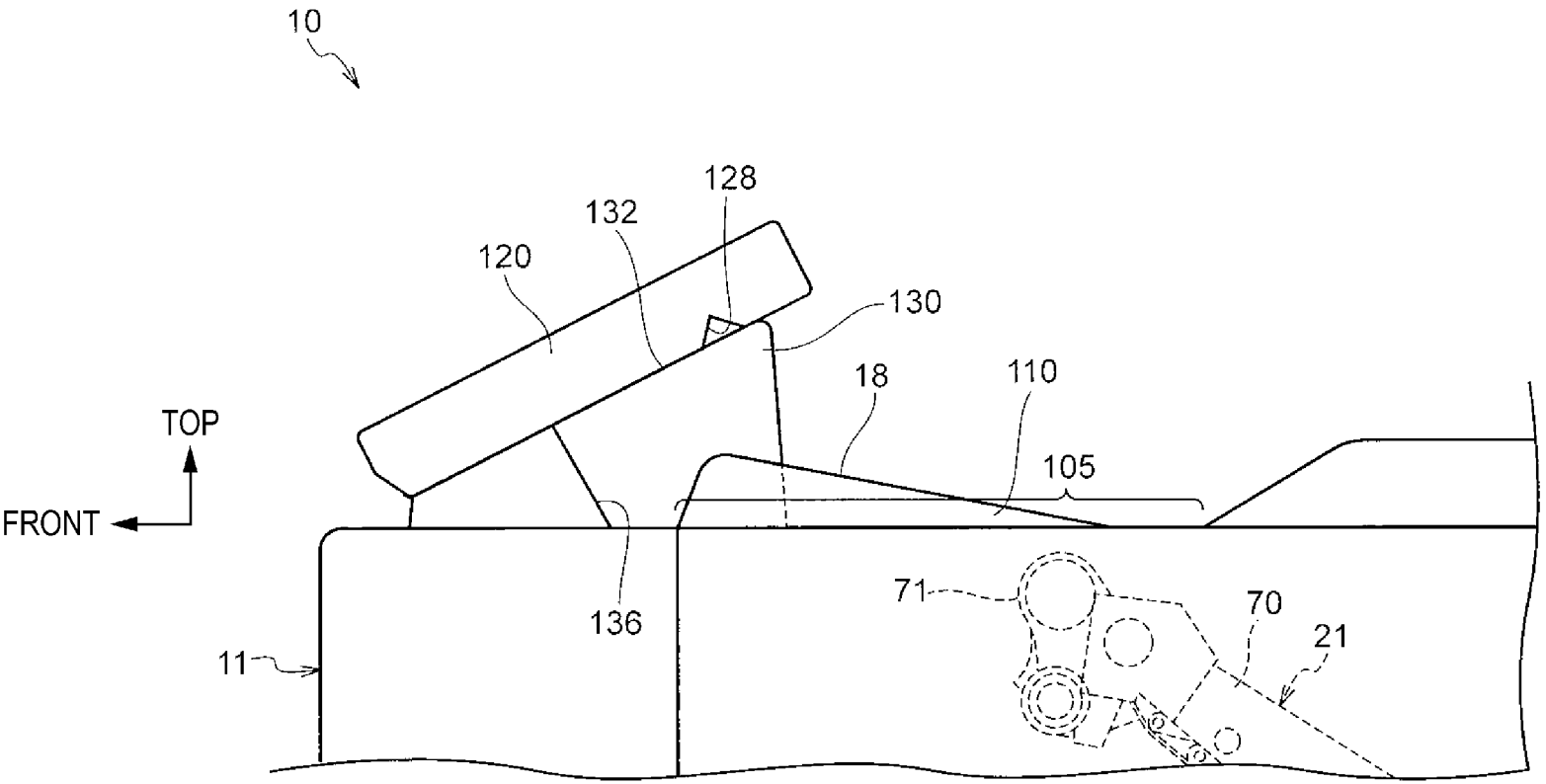
FIG. 5 is a side view illustrating the structure of an upper section of the image forming apparatus body according to the exemplary embodiment.

As illustrated in FIGS. 4 and 5, an opening 105, through which the transfer unit 21 is taken out of the image forming apparatus body 11, is formed in the upper section of the image forming apparatus body 11. As illustrated in FIGS. 3 and 4, an opening-closing cover 110 (example of opening-closing portion), which opens and closes the opening 105, an operation panel 120 (example of operating portion), which is operated by an operator, such as a user, and a panel support 130 (example of support), which supports the operation panel 120, are provided on the upper section of the image forming apparatus body 11.

As illustrated in FIG. 5, the opening 105 is located in front of and obliquely above the transfer unit 21. The guide grooves (not shown) formed in the inner walls of the image forming apparatus body 11 guide the projections 72 (see FIG. 2) formed on the frame members 70, thereby allowing the transfer unit 21 to be taken out through the opening 105 in a forward and obliquely upward direction. In this manner, the transfer unit 21 disposed in the image forming apparatus body 11 is taken out of the image forming apparatus body 11 through the opening 105. Thus, in the present exemplary embodiment, the path along which the transfer unit 21 is taken out through the opening 105 in the forward and obliquely upward direction is the path along which the transfer unit 21 is taken out of the image forming apparatus body 11 through the opening 105.

The opening-closing cover 110 includes a rear end portion (example of rear portion of the opening-closing cover) that is attached to the upper section of the image forming apparatus body 11 in such a manner that the opening-closing cover 110 is rotatable around an axis that extends in a left-right direction of the apparatus. The opening-closing cover 110 rotates upward from a closed state (closed position) illustrated in FIGS. 3, 5, and 6, in which the opening-closing cover 110 closes the opening 105 by covering the opening 105, to open the opening 105 (see FIGS. 4, 7, and 8). Accordingly, in the present exemplary embodiment, the path along which the opening-closing cover 110 rotates upward from the closed state to open the opening 105 serves as an upward rotation trajectory of the opening-closing cover 110. The opening-closing cover 110 rotates downward from the open state (open position) illustrated in FIGS. 4, 7, and 8, in which the opening-closing cover 110 opens the opening 105, to close the opening 105 (see FIGS. 3, 5, and 6). In FIG. 3, the dotted area is the opening-closing cover 110.

Figure 9:
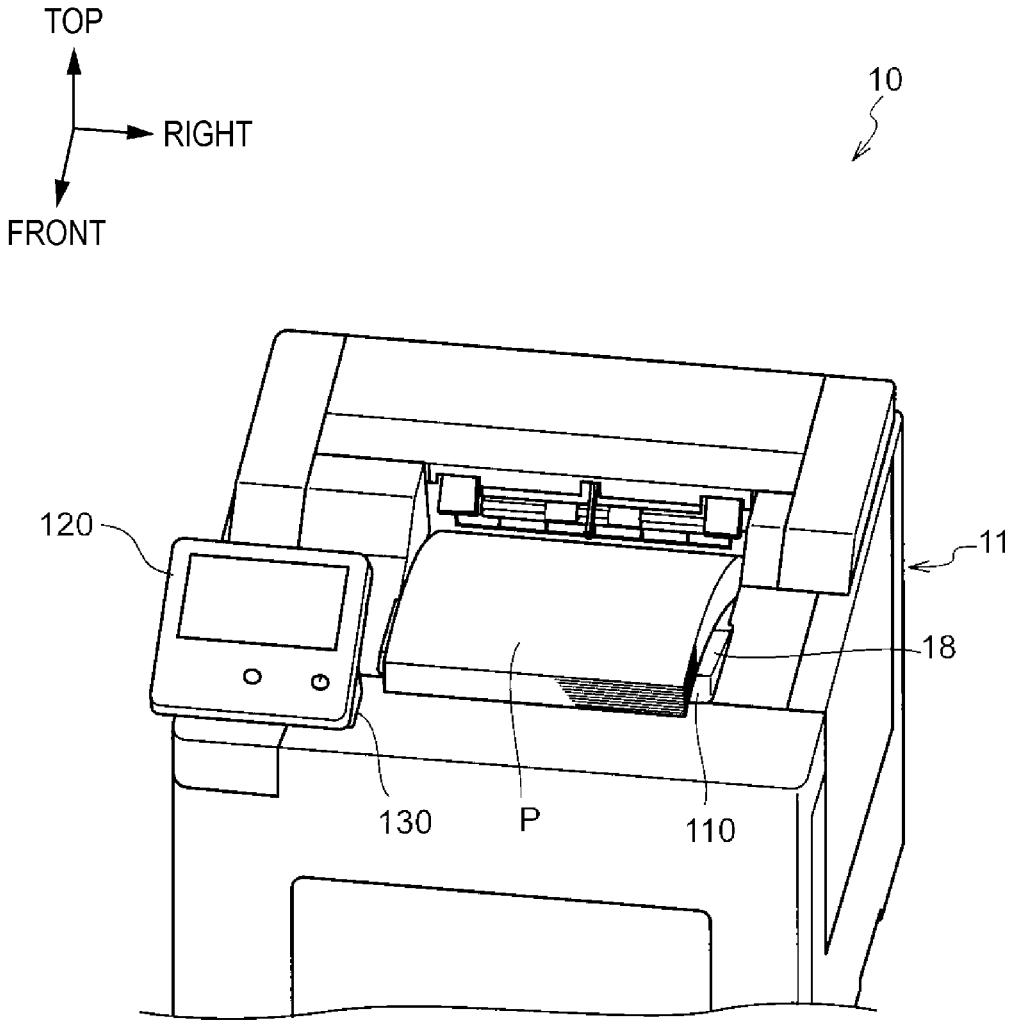
FIG. 9 is a perspective view illustrating the state in which recording media are placed on the opening-closing cover, which serves as an output portion according to the exemplary embodiment.

As illustrated in FIG. 9, the opening-closing cover 110 serves as the output portion 18 in the closed state in which the opening-closing cover 110 covers the opening 105. More specifically, the recording media P output from the image forming apparatus body 11 are stacked on a portion of the top surface of the opening-closing cover 110 in the left-right direction.

As illustrated in FIGS. 3 and 4, the panel support 130 is located closer to the front of the apparatus than the opening-closing cover 110 is at the left end of the upper section of the image forming apparatus body 11. In front view, a right portion of the panel support 130 overlaps a left portion of the opening-closing cover 110 in the left-right direction (see FIG. 9). In side view, a rear portion of the panel support 130 overlaps a front portion of the opening-closing cover 110 in the front-rear direction (see FIG. 6).

Figure 6:
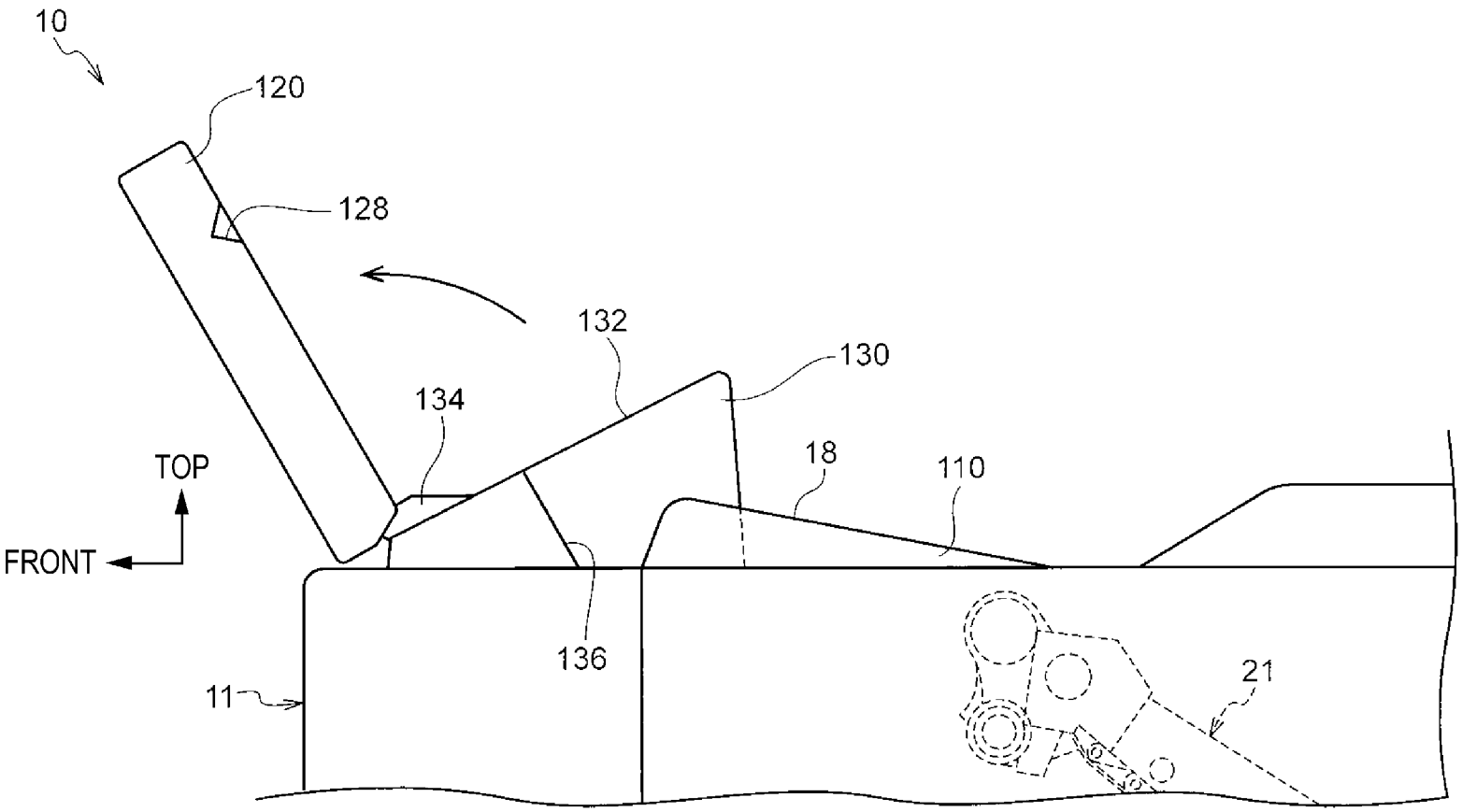
FIG. 6 is a side view illustrating the manner in which an operation panel is rotated forward from the state illustrated in FIG. 5.

As illustrated in FIG. 6, the panel support 130 projects upward from the top surface of the image forming apparatus body 11. The panel support 130 has a top surface 132 that is inclined upward toward the rear. The top surface 132 functions as a surface that receives the rear surface of the operation panel 120. A hinge portion 134 (support portion), which supports the bottom end portion of the operation panel 120 in such a manner that the operation panel 120 is rotatable around an axis that extends in the left-right direction of the apparatus, is provided on a front portion of the top surface 132.

Figure 10:
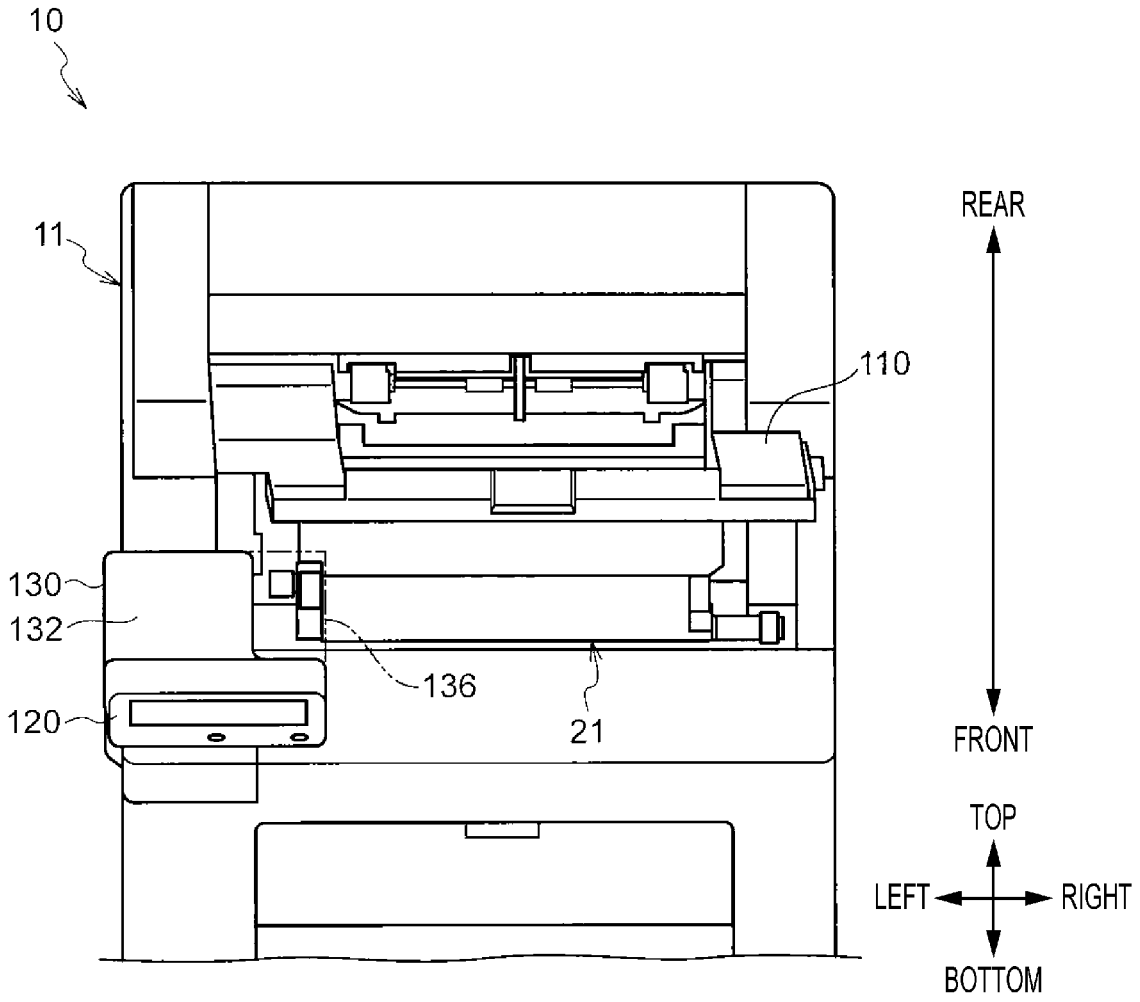
FIG. 10 illustrates the image forming apparatus viewed from the upper front in the state illustrated in FIG. 4.

As illustrated in FIG. 10, the panel support 130 has a cut portion 136 (example of cut) in a right rear section thereof. The cut portion 136 is located on the rotation trajectory along which the opening-closing cover 110 rotates upward and on a path along which the transfer unit 21 is taken out of the image forming apparatus through the opening 105.

The operation panel 120 is plate-shaped. The front surface of the operation panel 120 is a touch panel that functions as a display portion that displays various information for the operator and as an operating portion that is operated by the operator.

The bottom end portion of the operation panel 120 is supported by the hinge portion 134 so that the operation panel 120 is attached, in such a manner that the operation panel 120 is rotatable around an axis that extends in the left-right direction of the apparatus, to the upper section of the image forming apparatus body 11 at a position closer to the front of the apparatus than the opening-closing cover 110 is.

When the operation panel 120 is in the lying position (lying state) illustrated in FIGS. 3 and 5, in which the rear surface of the operation panel 120 is placed on the top surface 132 of the panel support 130, the operation panel 120 is located on the rotation trajectory along which the opening-closing cover 110 rotates upward and on the path along which the transfer unit 21 is taken out of the image forming apparatus through the opening 105.

The operation panel 120 is retracted from the rotation trajectory of the opening-closing cover 110 and from the path along which the transfer unit 21 is taken out (see FIGS. 4 and 6) by being rotated toward the front of the apparatus from the lying position at which the operation panel 120 is placed on the top surface 132 of the panel support 130. When the opening-closing cover 110 is opened while the operation panel 120 is in the retracted position (retracted state), the path along which the transfer unit 21 is taken out is formed between the operation panel 120 and the opening-closing cover 110 in the open state. Namely, the transfer unit 21 is taken out of the image forming apparatus body 11 through the space between the opening-closing cover 110 in the open state and the rear surface of the operation panel 120 in the retracted state at the side opposite to the side of the touch panel.

The operation panel 120 returns to the lying position, at which the operation panel 120 is placed on the top surface 132 of the panel support 130, by being rotated toward the rear of the apparatus from the above-described retracted position. The operation panel 120 may be operated while the operation panel 120 is in the lying position and the retracted position.

Figure 11:
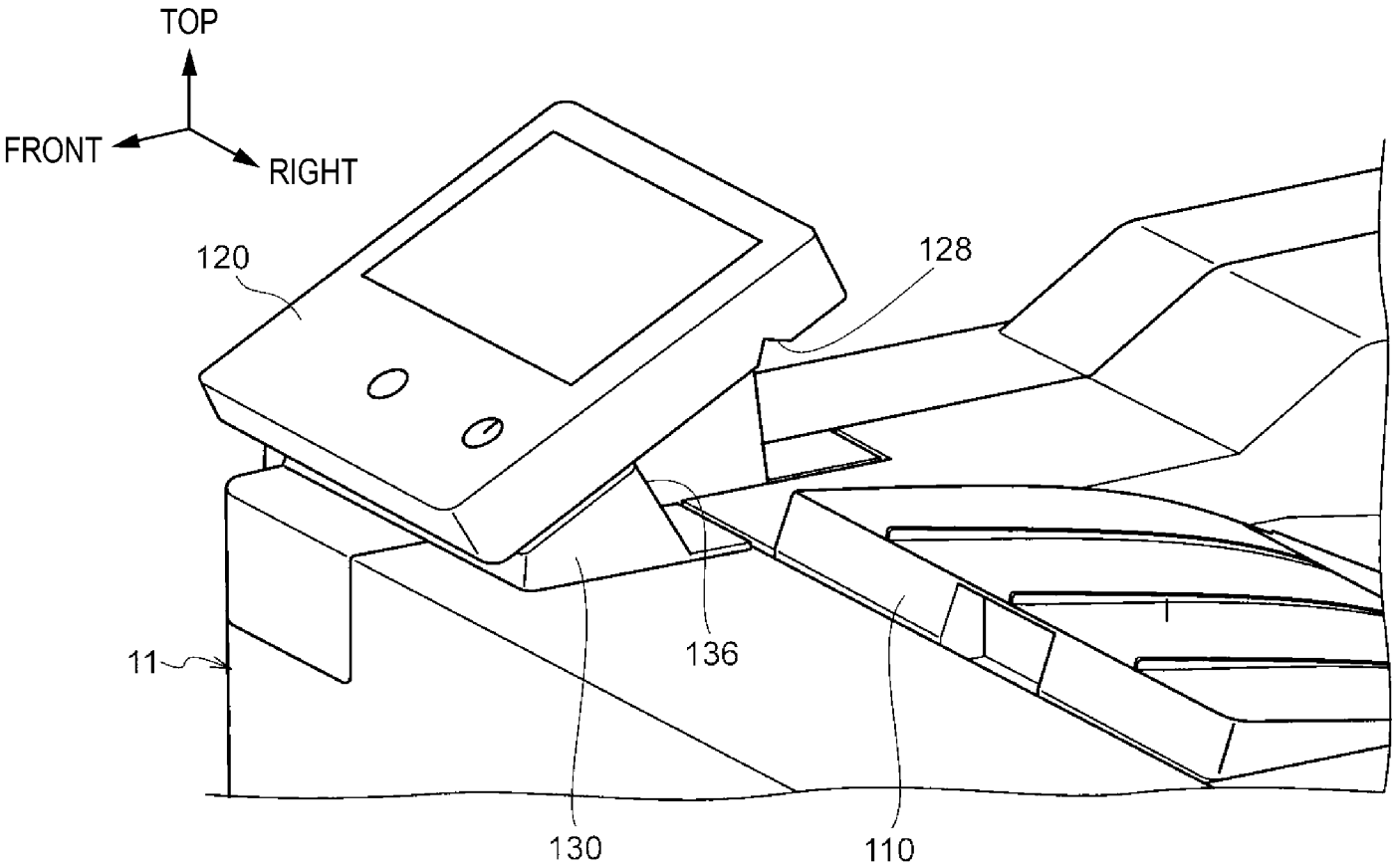
FIG. 11 is an enlarged perspective view of the operation panel according to the exemplary embodiment.
Figure 12:
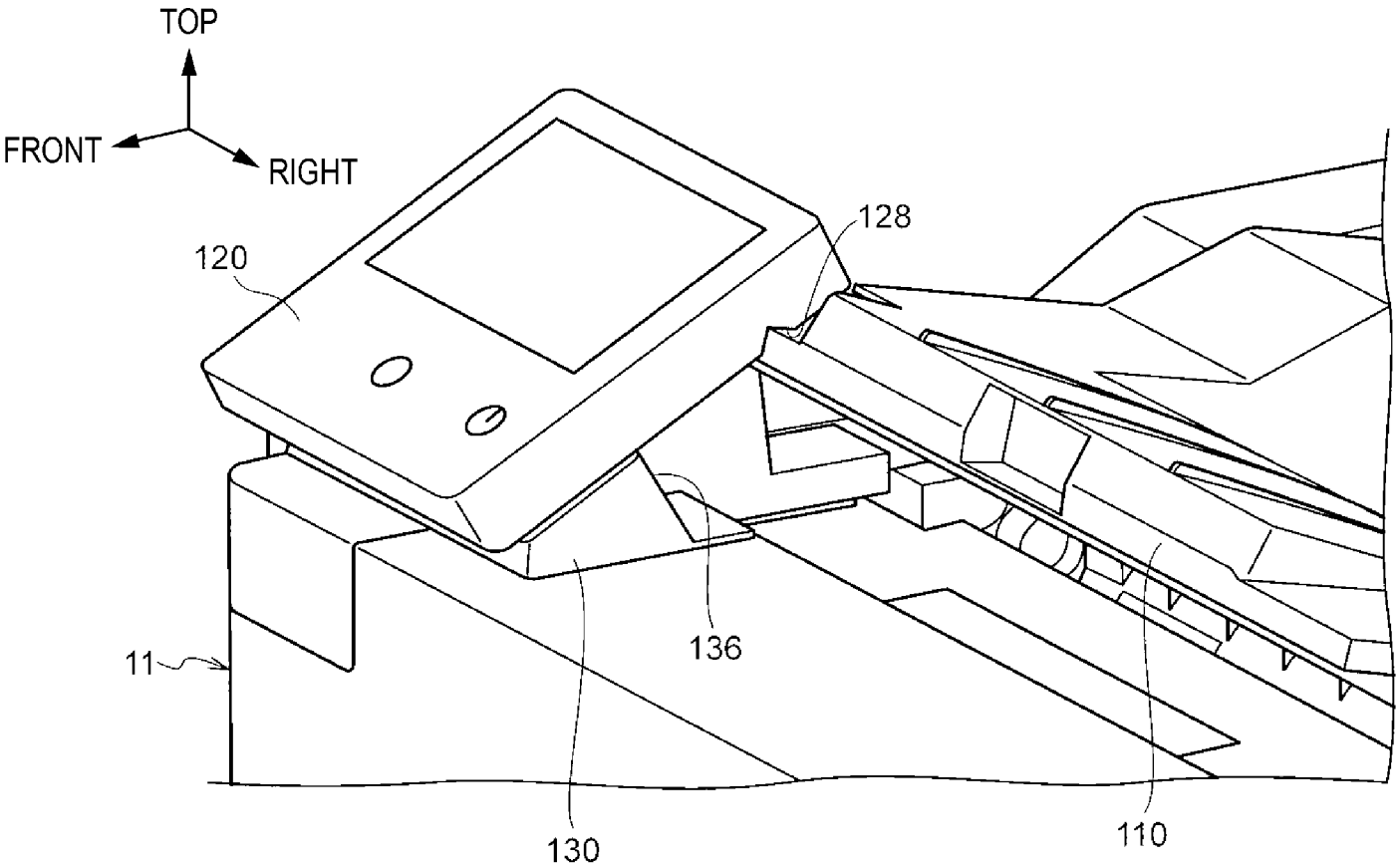
FIG. 12 is a perspective view illustrating the state in which the opening-closing cover is being opened from the state illustrated in FIG. 11.

As illustrated in FIGS. 11 and 12, the operation panel 120 is provided with a restricting portion 128 (example of restricting portion) that restricts the opening movement of the opening-closing cover 110 when the operation panel 120 is in the lying position (lying state). More specifically, the restricting portion 128 is a groove formed in the rear surface of the operation panel 120. When the opening-closing cover 110 is rotated upward from the closed state while the operation panel 120 is in the lying state, as illustrated in FIG. 12, the opening-closing cover 110 comes into contact with the restricting portion 128, so that further rotation is restricted.

Operation of Present Exemplary Embodiment

The operation of the present exemplary embodiment will now be described.

In the present exemplary embodiment, to take the transfer unit 21 out of the image forming apparatus body 11, first, the operator rotates the operation panel 120 toward the front of the apparatus (see FIG. 6) from the lying position in which the operation panel 120 is placed on the top surface 132 of the panel support 130 (see FIGS. 3 and 5). Thus, the operation panel 120 is retracted from the rotation trajectory of the opening-closing cover 110 and from the path along which the transfer unit 21 is taken out.

Figure 7:
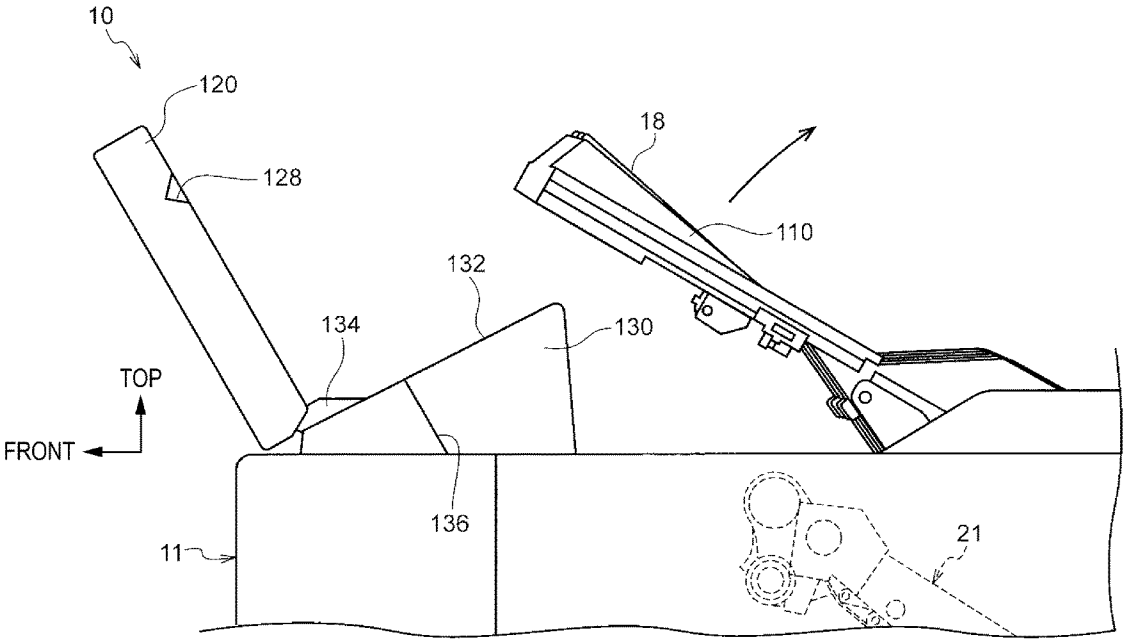
FIG. 7 is a side view illustrating the state in which an opening-closing cover is opened from the state illustrated in FIG. 6.

Next, the operator rotates the opening-closing cover 110 upward from the closed state (closed position) illustrated in FIG. 6 in which the opening-closing cover 110 closes the opening 105 (see FIG. 7). Thus, the opening-closing cover 110 opens the opening 105. In addition, the path along which the transfer unit 21 is taken out is formed between the operation panel 120 in the retracted state and the opening-closing cover 110 in the open state.

Figure 8:
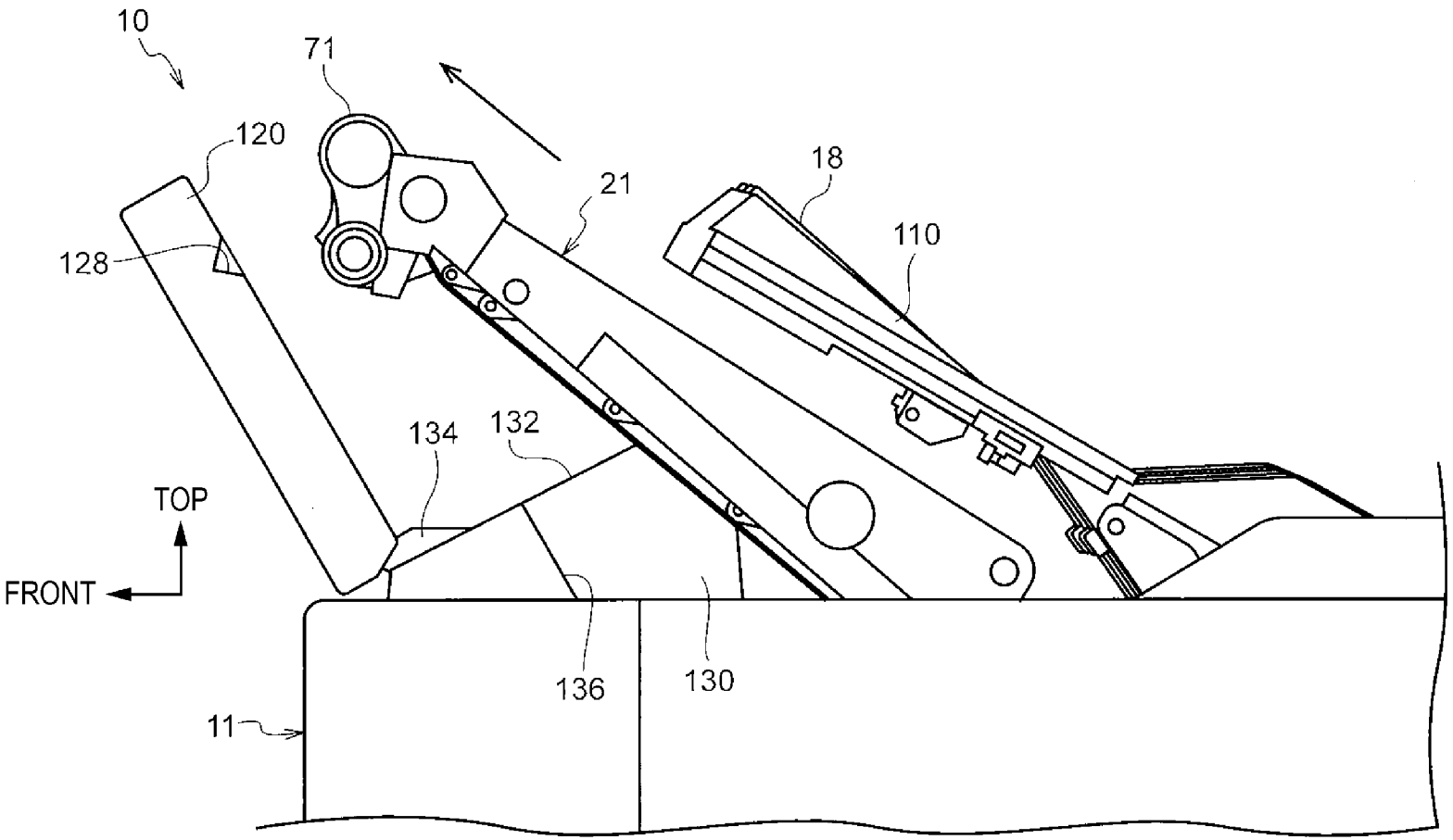
FIG. 8 is a side view illustrating the state in which the transfer unit is being taken out of the image forming apparatus body illustrated in FIG. 7.

Then, as illustrated in FIGS. 4 and 8, the operator holds the holder portions 71 of the transfer unit 21 and takes out the transfer unit 21 in a forward and obliquely upward direction through the opening 105. Thus, the transfer unit 21 is taken out of the image forming apparatus body 11 through the space between the operation panel 120 in the retracted state and the opening-closing cover 110 in the open state.

If the operation panel 120 is located to the left of the rotation trajectory of the opening-closing cover 110 and the path along which the transfer unit 21 is taken out (comparative example), the operation panel 120 does not interfere with the transfer unit 21 that is taken out. However, the operation panel 120 projects leftward from the image forming apparatus body 11, and the width of the image forming apparatus 10 in the left-right direction increases. As a result, the size of the image forming apparatus 10 increases.

In contrast, in the present exemplary embodiment, the operation panel 120 does not project from the image forming apparatus body 11 in the left-right direction. Therefore, unlike the above-described comparative example, the size of the image forming apparatus 10 may be reduced while reducing the occurrence of interference between the transfer unit 21 and the operation panel 120 when the transfer unit 21 is taken out.

In addition, in the present exemplary embodiment, the path along which the transfer unit 21 is taken out is formed between the operation panel 120 in the retracted state and the opening-closing cover 110 in the open state. Therefore, the operation panel 120 in the retracted state, the space through which the transfer unit 21 is taken out, and the opening-closing cover 110 in the open state overlap. Accordingly, it is not necessary to provide a large space for taking out the transfer unit 21, and the size of the apparatus may be reduced.

In addition, in the present exemplary embodiment, as illustrated in FIG. 10, the cut portion 136 of the panel support 130 is located on the rotation trajectory along which the opening-closing cover 110 rotates upward and on the path along which the transfer unit 21 is taken out of the image forming apparatus through the opening 105. Therefore, the occurrence of interference between the panel support 130 and the transfer unit 21 when the transfer unit 21 is taken out is lower than that in the structure in which the cut portion 136 is not provided.

In addition, in the present exemplary embodiment, as illustrated in FIG. 12, the restricting portion 128 restricts the opening movement of the opening-closing cover 110 when the operation panel 120 is in the lying state. Therefore, the risk that the opening-closing cover 110 will be opened while the operation panel 120 is not retracted from the rotation trajectory of the opening-closing cover 110 and from the path along which the transfer unit 21 is taken out is lower than that in the structure in which the opening movement of the opening-closing cover 110 is not restricted.

In addition, in the present exemplary embodiment, by rotating the operation panel 120 toward the front of the apparatus (see FIG. 6) from the lying position (see FIGS. 3 and 5) in which the operation panel 120 is placed on the top surface 132 of the panel support 130, the height (angle) of the operation panel 120 may be adjusted so that the operation panel 120 may be easily operated by, for example, an operator who is short or an operator sitting on a wheelchair. Thus, in the present exemplary embodiment, the rotation direction in which the operation panel 120 is rotated to adjust the height (angle) of the operation panel 120 is the same as the rotation direction in which the operation panel 120 is rotated to enable the transfer unit 21 to be taken out. Therefore, the size of the rotating mechanism, such as a hinge, is not increased. When, for example, the rotation directions are not the same and the operation panel 120 is rotated around two axes, a larger rotating mechanism, such as a hinge, is necessary.

Modifications

In the present exemplary embodiment, the transfer unit 21 is described as an example of the object to be taken out. However, the object to be taken out is not limited to this, and may instead be, for example, a waste toner box that contains waste toner or any other component that is taken out of the image forming apparatus body 11.

In the present exemplary embodiment, the restricting portion is a groove. However, the restricting portion is not limited to this, and may instead be, for example, a projection that projects downward from the rear surface of the operation panel 120.

The present invention is not limited to the above-described exemplary embodiment, and various modifications, changes, and improvements are possible without departing from the gist of the present invention. For example, the above-described modifications may be employed in combination as appropriate.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an object capable of being taken out of an apparatus body through an opening in an upper section of the apparatus body;

an opening-closing portion including a rear portion attached to the upper section so that the opening-closing portion is rotatable around a first axis that extends in a left-right direction of the apparatus, the opening-closing portion being configured to cover the opening from above and being configured to rotate upward to open the opening; and an operating portion attached to the upper section so as to be rotatable around a second axis that extends in the left-right direction at a location closer to a front of the apparatus than the opening-closing portion, the operating portion being disposed at a position on a rotation trajectory along which the opening-closing portion rotates upward and on a path along which the object may be taken out of the apparatus body through the opening, the operating portion being configured to rotate toward the front of the apparatus so as to be retracted from the rotation trajectory and the path and so that the path is formed between the operating portion and the opening-closing portion in a state in which the opening-closing portion opens the opening, wherein the second axis is disposed at a position above a lowermost part of the opening-closing portion.

2. The image forming apparatus according to claim 1, further comprising:

a restricting portion that is provided on the operating portion and that is configured to restrict an opening movement of the opening-closing portion when the operating portion is at the position on the rotation trajectory.

3. The image forming apparatus according to claim 2, wherein the restricting portion is configured to restrict the opening movement of the opening-closing portion when the operating portion is at the position on the path.

4. The image forming apparatus according to claim 1, further comprising:

a restricting portion that is provided on the operating portion and that is configured to restrict an opening movement of the opening-closing portion when the operating portion is at the position on the rotation trajectory and on the path.

5. The image forming apparatus according to claim 1, wherein the operating portion is configured to receive an instruction from a user at the retracted position.

6. The image forming apparatus according to claim 1, wherein the operating portion is configured to process an electric signal in response to an instruction from a user at the retracted position.

7. The image forming apparatus according to claim 1, wherein the second axis is disposed at a position above a top end of the object disposed in the apparatus body.

8. The image forming apparatus according to claim 1, wherein the operating portion is configured to rotate toward the front of the apparatus after rotating upward from the position on the rotation trajectory.

9. The image forming apparatus according to claim 1, wherein the opening-closing portion has an outer surface and an inner surface which is opposite to the outer surface, the outer surface constituting an outside surface of the apparatus body, the inner surface constituting an inside surface of the apparatus body, wherein the operating portion has a front surface and a rear surface which is opposite to the front surface, wherein the front surface is configured to receive an instruction from a user, and wherein the opening-closing portion and the operating portion are configured to form at least one part of the path between the inner surface of the opening-closing portion and the rear surface of the operating portion.

10. The image forming apparatus according to claim 1, wherein the opening-closing portion includes an output portion configured to stack a recording medium, which is output from the apparatus body.

11. An image forming apparatus comprising:

an object disposed capable of being taken out of an apparatus body through an opening in an upper section of the apparatus body;

an opening-closing portion including a rear portion attached to the upper section so that the opening-closing portion is rotatable around a first axis that extends in a left-right direction of the apparatus, the opening-closing portion being configured to cover the opening from above and being configured to rotate upward to open the opening;

an operating portion attached to the upper section so as to be rotatable around a second axis that extends in the left-right direction at a location closer to a front of the apparatus than the opening-closing portion, the operating portion being disposed at a position on a rotation trajectory along which the opening-closing portion rotates upward and on a path along which the object may be taken out of the apparatus body through the opening, the operating portion being configured to rotate toward the front of the apparatus so as to be retracted from the rotation trajectory and the path and so that the path is formed between the operating portion and the opening-closing portion in a state in which the opening-closing portion opens the opening; and a support provided on the upper section at a location closer to the front of the apparatus than the opening-closing portion, the support supporting a bottom end portion of the operating portion so that the operating portion is rotatable around the second, the support including a cut on the rotation trajectory.

12. The image forming apparatus according to claim 11, wherein the cut is on the path.

13. The image forming apparatus according to claim 11, wherein the operating portion is configured to receive an instruction from a user at the retracted position.

14. The image forming apparatus according to claim 11, wherein the operating portion is configured to process an electric signal in response to an instruction from a user at the retracted position.

15. The image forming apparatus according to claim 11, wherein the second axis is disposed at a position above a top end of the object disposed in the apparatus body.

16. The image forming apparatus according to claim 11, wherein the operating portion is configured to rotate toward the front of the apparatus after rotating upward from the position on the rotation trajectory.

17. The image forming apparatus according to claim 11, wherein the opening-closing portion has an outer surface and an inner surface which is opposite to the outer surface, the outer surface constituting an outside surface of the apparatus body, the inner surface constituting an inside surface of the apparatus body, wherein the operating portion has a front surface and a rear surface which is opposite to the front surface, wherein the front surface is configured to receive an instruction from a user, and wherein the opening-closing portion and the operating portion are configured to form at least one part of the path between the inner surface of the opening-closing portion and the rear surface of the operating portion.

18. The image forming apparatus according to claim 11, wherein the opening-closing portion includes an output portion configured to stack a recording medium, which is output from the apparatus body.

19. An image forming apparatus comprising:

an object capable of being taken out of an apparatus body through an opening in an upper section of the apparatus body;

an opening-closing portion including a rear portion attached to the upper section so that the opening-closing portion is rotatable around a first axis that extends in a left-right direction of the apparatus, the opening-closing portion being configured to cover the opening from above and being configured to rotate upward to open the opening; and an operating portion attached to the upper section so as to be rotatable around a second axis that extends in the left-right direction at a location closer to a front of the apparatus than the opening-closing portion, the operating portion being disposed at a position on a rotation trajectory along which the opening-closing portion rotates upward and on a path along which the object may be taken out of the apparatus body through the opening, the operating portion being configured to rotate toward the front of the apparatus so as to be retracted from the rotation trajectory and the path and so that the path is formed between the operating portion and the opening-closing portion in a state in which the opening-closing portion opens the opening, wherein the operating portion is configured to process an electric signal in response to an instruction from a user at the retracted position.

20. The image forming apparatus according to claim 19, wherein the second axis is disposed at a position above a top end of the object disposed in the apparatus body.

* * * * *